United States Patent [19]

Elbel

[11] 4,338,748

[45] Jul. 13, 1982

[54] GRINDING TOOL METAL MACHINING

[75] Inventor: Karl Elbel, Pforzheim, Fed. Rep. of Germany

[73] Assignee: Firma Heinrich Lippert GmbH, Pforzheim, Fed. Rep. of Germany

[21] Appl. No.: 159,697

[22] Filed: Jun. 16, 1980

[30] Foreign Application Priority Data

Jun. 26, 1979 [DE] Fed. Rep. of Germany ... 7918301[U]
Aug. 4, 1979 [DE] Fed. Rep. of Germany ..... 2931695

[51] Int. Cl.[3] ..... B24B 5/00
[52] U.S. Cl. ..... 51/206 R; 51/326; 51/400; 51/181 R
[58] Field of Search ..... 51/400, 207, 206 R, 51/289 R, 326, 181 R

[56] References Cited

U.S. PATENT DOCUMENTS

| | | | |
|---|---|---|---|
| 1,616,531 | 2/1927 | King | 51/207 |
| 2,121,496 | 6/1938 | Bowen | 51/400 |
| 2,405,524 | 8/1946 | Sharpe | 51/400 |
| 2,540,112 | 2/1951 | Goepfert | 51/400 X |
| 3,067,551 | 12/1962 | Maginnis | 51/289 R |
| 3,260,582 | 7/1966 | Zimmer | 51/400 |
| 3,299,579 | 1/1967 | Jacobson | 51/206 R |

*Primary Examiner*—Harold D. Whitehead
*Attorney, Agent, or Firm*—Hubbell, Cohen, Stiefel & Gross

[57] ABSTRACT

A grinding tool for metal machining which is provided with matrix-bonded abrasive grains, the hardness of the matrix varying over the grinding area, along which the workpiece moves in a single operation during its passage.

14 Claims, 7 Drawing Figures

Figure 1:
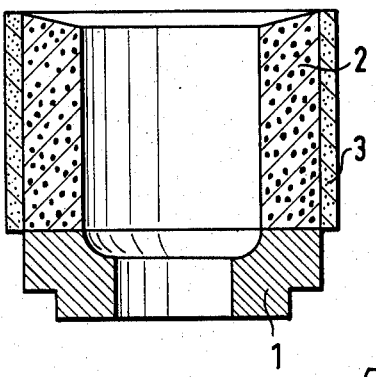

FIG.5
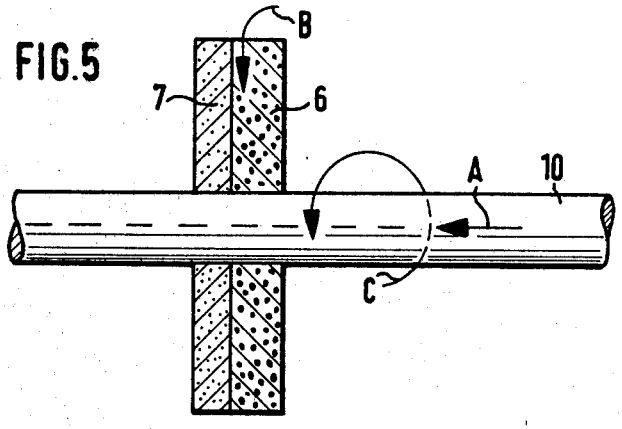
FIG.6
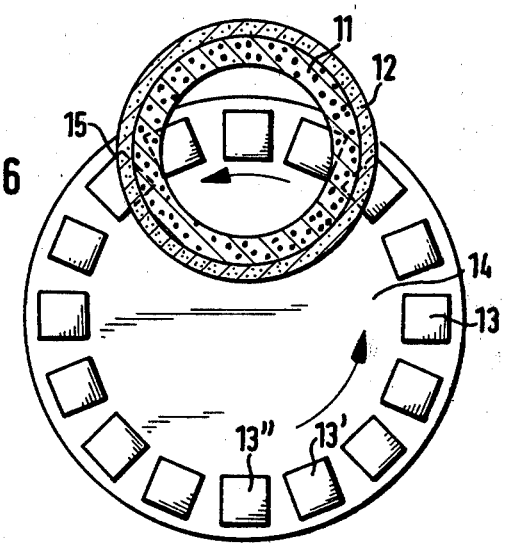
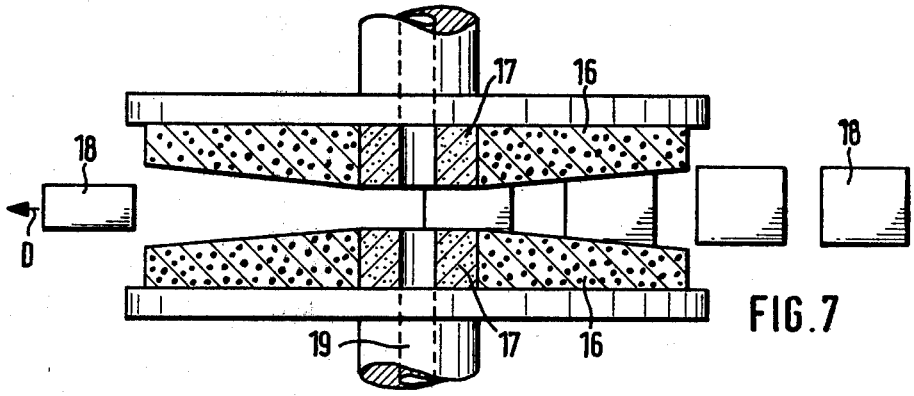
FIG.7

GRINDING TOOL METAL MACHINING

The wish to have grinding tools which allow rough- and fine-grinding to be performed in a single operation has existed in industry for a long time. However, trials carried out within some companies in this regard have so far failed due to the fact that after a short working time the grinding tools tended to "burn" in the fine-grinding area, in other words the surface of the workpiece tended to become overheated because the grinding pressure in the fine-grinding area became too high after the rough-grinding area had worn away.

From CB PS 210 945, there is known a grinding tool of the kind described at the beginning wherein the grinding area along which the workpiece moves in single operation has at both ends an edge zone which has a harder matrix and a finer grain than a central zone. The object of this measure is to render the more heavily loaded edge zones of the grinding tool more resistant, which results in a more uniform wear. Rough and fine grinding in a single operation cannot be brought about with this known grinding tool because at the beginning and end of the grinding process the workpiece is subjected to a grinding surface which has the same characteristics with respect to matrix hardness and grain size.

From DE GM 19 64 604, there is known a wheel for grinding and polishing precious and gem stones which combines a grinding area and a polishing area in one tool. The grinding area consists of a copper or aluminium wheel, on the circumference of which diamond abrasive grain has been sintered, electrodeposited or bonded by synthetic resin. The polishing area is to consist of soft metals and alloys of soft metals, particularly of copper, acrylic glass or other synthetic materials as well as wood. The grinding and polishing areas thus consist either of identical materials or of materials which hardly differ as regards their resilience. In the case of jewellery industry grinding/polishing wheels, the workpiece hardly ever rests simultaneously against the grinding area and the polishing area. On the contrary, the stone is lifted from the grinding area after grinding and is then pressed separately against the polishing area. The above-mentioned problem of "burning" does not arise in connection with gem stones because the material is entirely different and because no further material is removed during gem stone polishing.

From U.S. Pat. No. 3,510,283, there is known a grinding tool which has a matrix consisting of a fibre fleece with a plastic bonding, in which the abrasive grains are embedded. Rough- and fine-grinding in a single operation is not possible with this grinding tool.

The task underlying the invention is to design a grinding tool of the kind mentioned at the beginning so that it is possible to rough- and fine-grind therewith in a single operation with no tendency towards "burning", in other words towards the overheating of the metal surface to be machined, arising in the fine-grinding area.

According to the invention, this problem is solved in that in the direction in which the workpiece moves relative to the grinding tool, the grinding area consists initially of a rough-grinding area comprising a hard matrix and subsequently of a fine-grinding area which is fixedly connected to the rough-grinding area and comprises a matrix consisting of textile material that is more flexible than the material of the hard matrix and has an open structure; the strength of the fine-grinding area relative to that of the rough-grinding area being so dimensioned that, with the workpiece abutting over the entire grinding area, at the outside that proportion of the entire grinding pressure is absorbed in the fine-grinding area that corresponds to the proportion of its contact surface relative to the workpiece.

With the grinding tool according to the invention it is possible for the first time to rough- and fine-grind workpieces in a single operation. The grinding tool according to the invention is subdivided into two areas which are distinctly different in their characteristics but are fixedly coherent. In the rough-grinding area, the abrasive grain is bonded in a hard matrix while, in the fine-grinding area, the grains are held in a substantially softer matrix made of textile material. Surprisingly, it has turned out that despite these matrix materials being so entirely different in their resilience, there is achieved an adequate stock abrasion in the rough-grinding area and an abrasion in the fine-grinding area which, although reduced in scope, is still sufficient for fine-grinding. Due to the fact that the fine-grinding area only maximally transmits the proportion of the entire grinding pressure that corresponds to its proportion of contact with the workpiece, any tendency towards burning is impossible. Due to use being made of a textile material as the matrix in the fine-grinding area, the resilience of this area can be exactly adapted so that, with the rough-grinding area not yet worn, the grinding pressure in the fine-grinding area is sufficient so as to ensure a neat fine-grind and, with the rough-grinding area heavily worn, the grinding pressure will not become too high in the fine-grinding area.

Figure 3:
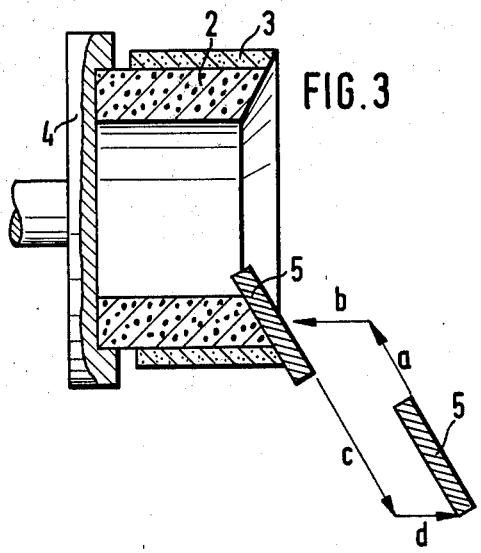
Figure 2:
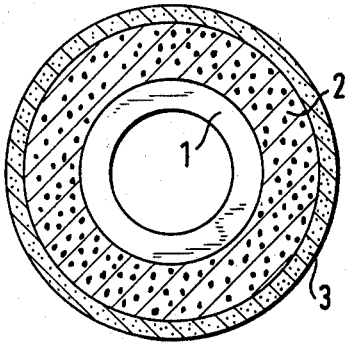
Figure 4:
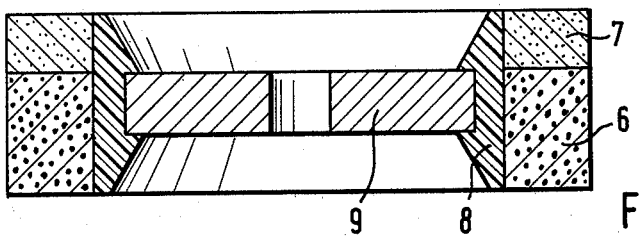

Further advantages and details of the grinding tool according to the invention will be described hereinafter with reference to exemplified embodiments and in conjunction with the drawings, in which:

FIGS. 1 and 2 show a longitudinal section and a top view of a ring- or cup-shaped grinding tool, FIG. 3 shows a longitudinal section of a ring- or cup-shaped grinding tool, as shown in FIGS. 1 and 2, during the grinding of a knife, FIG. 4 shows a longitudinal section through a grinding tool in the shape of a wheel, FIG. 5 shows a side view of the grinding tool, as shown in FIG. 4, in the shape of a wheel during the grinding of a tube, FIG. 6 shows a top view of a ring or cup wheel according to the invention during the machining of workpieces on a revolving table, and FIG. 7 shows a top view of a double grinding-wheel arrangement with workpieces passing through.

In the first exemplified embodiment shown in FIGS. 1 and 2, there is provided for the grinding tool in the shape of a ring or cup a carrying element 1 which is made of metal, wood or a grinding compound and serves for being plugged onto a machine shaft. The grinding tool has a rough-grinding area 2, which serves for rough-grinding and has to perform the abrasion work, and a fine-grinding area 3.

FIG. 3 shows the mode of operation of this grinding tool in the shape of a ring or cup. Therein, it is mounted on a base plate 4 of an automatic grinding machine. The workpiece 5 to be ground, for example a knife blade in this case, is advanced towards the grinding tool in the direction of the arrows a, b and is guided in the direction of the arrow over the grinding area 2 and 3 in a single operation, possibly in an oscillating manner, for an adjustable time. Finally, once the machining has been effected, the work supporting device is moved away in the direction of the arrow d.

In this embodiment, the rough-grinding area 2 of the grinding tool is constructed of known 'per se' abrasive grain and a hard matrix, such as natural abrasive grain types, corunda, silicon carbide and others, and a matrix consisting of hydrating or ceramic substances, magnesite, synthetic resin or hard rubber. As the grain size, there is preferably chosen the finest grain size that is just about still capable of performing the rough stock abrasion required on the workpiece. Compositions as given in DE OSs 17 52 612, 27 30 665 and 28 22 910 have proved to be particularly suitable for the construction of the rough-grinding area 2 of the grinding tool.

The fine-grinding area 3 consists of abrasive grain of a type that is identical to or different from that of the rough-grinding area 2, but the grain size is in most cases of a finer nature so that the peak-to-valley height of the rough-grinding area 2 left on the workpiece is levelled and refined to such an extent that the desired grinding pattern comes about. The fine-grinding area 3 may also consist of two or more areas of stepped grain size. Of special importance is the matrix used in the fine-grinding area 3. This area is to absorb at the outside as much of the grinding pressure exerted against the workpiece as corresponds to its proportion of the entire contact surface of the workpiece and must exert on the workpiece an amount of grinding pressure that is still just about sufficient for achieving the desired fine-grinding effect. This is brought about in that the matrix of the fine-grinding area 3 is designed so as to be more flexible than that of the rough-grinding area 2. This is brought about in that the matrix of the fine-grinding area consists of an open-structured textile material, for example a tangled fibre fleece, in which the abrasive grains or abrasive grain conglomerates are embedded.

It has turned out to be particularly favourable if the fine-grinding area 3 is made separately from the rough-grinding area 2 and if the fine-grinding area 3 is subsequently fixedly connected to the rough-grinding area 2. This provides a wide variety of possibilities of optimally adjusting the rough- and fine-grinding areas to the machine, the workpiece, the material and the type of grinding, e.g. wet or dry.

In order to set the desired flexibility in the fine-grinding area 3, a secondary bonding agent is preferably used in addition to the textile matrix so as to hold the textile structures together and to solidify them. After having been relieved from the grinding pressure, the textile matrix of the fine-grinding area projects from the rough-grinding area 2 but can be easily pressed back. After having been in operation for a short time, the textile matrix is frayed in the fine-grinding area proper, which advantageously supports the fine-grinding to polishing effect. During wet grinding, this fraying furthermore causes particularly much coolant to be taken along and brought to the grinding area precisely in the maximum circumferential speed zones, where the cooling liquid is spun off to the greatest extent. This grinding tool thus has practically no "tendency towards burning".

By an "open-structure textile material" there are to be understood elements formed by wound packages or layers, such as mats or felts, which are constructed of woven or non-woven textile raw materials. The layers of the textile fabric lie closely against one another to a greater or lesser extent and are preferably connected together by the secondary bonding agent. This secondary bonding agent itself is tough-elastic to elastomeric and is preferably foamed. If necessary, it may contain additional abrasive grain. The wound packages or layers may be applied in such a way that they comprise grain sizes which vary, that is to say become finer, in the direction of the workpiece advance. A wide variety of natural or synthetic bonding agents are eligible, such as foamed thermosetting plastics, dispersion bonding agents, polyvinyl chloride, rubber lattices, epoxy resins and polyesters which have been rendered elastic, polyurethanes and others, all being preferably foamed and, for bringing about an open structure by the incorporation of fillers or other measures, reduced in plasticity.

Surprisingly, it has turned out that precisely those bonding agents which are known to have a low wet strength, for example foamed polyurethanes, are eminently suitable as secondary bonding agents for the grain-containing textile structures of the fine-grinding area 3 in wet grinding. While the rough-grinding areas produced, for example, according to DE OSs 27 30 665 and 28 22 910 are very stable under wet grinding conditions in the alkaline range, despite their hydrophilicity, and yield high abrasion outputs, a polyurethane bonding agent in the fine-grinding area 3 makes the textile structure swell and renders this structure more resilient and softer in the grinding area, which promotes the cooling liquid being taken along.

In FIG. 4, there is shown a grinding tool in wheel form. The rough-grinding area 6 is connected to the fine-grinding area 7. They sit together on a cast-resin core 8 with a central wheel 9 made of wood, metal or a similar material. The use of such a grinding wheel is illustrated in FIG. 5 Either the workpiece 10, in this case for example a tube, hydraulic piston or the like, is guided past the grinding wheel in the direction of the arrow A or, if grinding is effected between centres, the grinding wheel is moved in the opposite direction. The grinding wheel itself moves in FIG. 5 on the front to the bottom in the direction of the arrow B, the tube also rotating on the front to the bottom in the direction of the arrow C. The desired abrasion on the workpiece is brought about by the rough-grinding area 6; the fine-grinding area 7 provides the desired fine surface pattern.

In this connection, it has also turned out that any spiral-shaped marks which sometimes appear during the machining of tubes, particularly in dry grinding, disappear. That is why the wheels according to the invention frequently allow one to two grinding or polishing stations to be dispensed with.

In FIG. 6, there is shown a ring or cup grinding wheel which is secured to a vertical spindle. The ring wheel provided with the rough-grinding area 11 and the fine-grinding area 12 serves for machining workpieces 13 which are held on a slowly rotating table 14. The work blanks are placed thereon at 13' and are removed at 13" after having been machined. The spindle of the ring wheel is inclined with respect to the grinding table 14 by a small amount so that the grinding area is located in the zone 15. Here, the workpieces 13 initially enter the rough-grinding area 11, where the desired abrasion is effected, and leave the ring wheel via the fine-grinding area 12, where the desired surface pattern is produced.

In FIG. 7, there is finally shown a top view of a double-wheel grinding machine with two grinding wheels to be screwed thereon and conforming, for example, to DIN 69 191 and which form rough-grinding areas 16 and fine-grinding areas 17, the latter in this case being located in the interior of the wheels. The workpieces 18 travel from the right-hand side into the closable gap between the wheels and leave this gap towards the left-hand side as shown by the arrow D. The grinding area is only on the right-hand side on these grinding machines, since the grinding wheels easily wear conically here in accordance with the abrasion effected on the workpieces 18. In this arrangement of the grinding wheels, too, the desired abrasion on the workpieces is effected in the rough-grinding area 16; the fine-grinding area 17 in the centre of the wheel then provides the desired surface pattern. In the zone between the grinding wheels from the centre to the left there no longer occurs any contact of the workpieces with the grinding wheel. In this case, the coolant supply is effected through the centre of the grinding wheels through a hollow shaft at 19.

Of course, other constructional forms of the grinding wheel according to the invention are possible. The known fine-grinding wheels for knife blades ("Pliesst" wheels) in the form of cup wheels having a relatively large diameter and a low abrasive coating height can advantageously be equipped so as to achieve a finer grinding pattern ("Blaupliesst" pattern). In this application, a special advantage of the fine-grinding area consists in that the open structure of this area takes along the grease used in this "Pliesst" process in a better manner and thus contributes towards a refinement of the grinding pattern.

Another application of the grinding wheels according to the invention is given in the machining of knife blades on machines which work with double headers. In this case, two grinding wheels of the construction shown in FIG. 4 run against each other around parallel spindles, one spindle being movable against the other. Both wheels run in opposite directions so that both run at the same speed downwards in their contact zone. The knife blades to be machined are manually or automatically introduced into this contact zone and, following the infeed of the movable wheel, are pulled out slowly, possibly by way of oscillation.

According to one exemplified embodiment, ring wheels according to DE OSs 17 52 612, 27 30 665 or 28 22 910 are made in the dimensions 350×120×270 and with corundum abrasive grain conglomerates of the grain sizes according to FEPA 150. Subsequently, a 10 mm thick and compacted tangled fibre fleece layer containing corundum of the grain size 180 is wound around these ring wheels, and the wheels are reinforced with polyurethane foam.

These wheels achieved, on the conventional machines and using the conventional coolants, on approximately 15 cm long and approximately 20 cm wide kitchen knife blades made of hardened high-quality steel not only the abrasion hitherto only achievable with the known magnesite ring wheels but also a surface pattern finer than that which was achievable by a previous method in a second operation with a known fine-grinding (Pliesst) wheel. In this connection, all that had to be done was to increase the cycle time from 20 to 22 sec. See in this context the mode of operation according to FIG. 3.

Grinding tools according to the present invention are thus capable of replacing one or several operations with a full saving in cost, while simultaneously increasing the quality of the final product.

The textile structures of the fine-grinding area may successfully consist of an appropriate different fibre material, for example fibre glass fabrics or mats which simultaneously protect the grinding wheel against a centrifugal force breakage. In this case, the fibre glass wound packages or layers are joined with, for example, epoxy resin which contains an optimum proportion of an appropriate abrasive grain. Of course, it is also possible to use other fabrics for the construction of this fine-grinding area, such as jute and sisal.

I claim:

1. In a grinding tool for the machining of metal which is provided with matrix-bonded abrasive grains, the hardness of the matrix varying over the grinding area, along which the workpiece moves in a single operation, in the travel direction of the workpiece relative to the grinding tool, the grinding area consists initially of a rough-grinding area with a hard matrix and subsequently of a fine-grinding area which is fixedly connected to the rough-grinding area, the improvement comprising said fine-grinding area comprising a flexible matrix consisting of a textile material which is more flexible than the material of a hard matrix and has an open structure, the strength of the fine-grinding area relative to that of the rough-grinding area being so dimensioned that, with the workpiece abutting over the entire grinding area, at the outside portion of the fine-grinding area, that proportion of the entire grinding pressure is absorbed in the fine-grinding area that corresponds to the proportion of its contact surface with respect to the workpiece.

2. A grinding tool as claimed in claim 1, wherein the fine-grinding area consists of several sub-areas having stepped grain sizes.

3. A grinding tool as claimed in claim 1, wherein the matrix of the fine-grinding area consists of several layers of an abrasive-coated cloth which is connected to a secondary bonding agent.

4. A grinding tool as claimed in claim 1 or claim 2, wherein the matrix of the fine-grinding area consists of a tangled fibre mat which is bonded with a secondary bonding agent and contains the abrasive grains.

5. A grinding tool as claimed in claim 1, 2 or 3, wherein the matrix of the fine-grinding area is designed as a textile wound package.

6. A grinding tool as claimed in claim 1, 2 or 3, wherein the secondary bonding agent is a tough-elastic to elastomeric, more especially foamed, plastics material.

7. A grinding tool as claimed in claim 1, 2 or 3, wherein additional abrasive grains are added to the secondary bonding agent.

8. In a grinding tool for the machining of metal which is provided with matrix-bonded abrasive grains, the hardness of the matrix varying over the grinding area, along which the workpiece moves in a single operation, in the travel direction of the workpiece relative to the grinding tool, the grinding area consists initially of a rough-grinding area with a hard matrix and subsequently of a fine-grinding area which is fixedly connected to the rough-grinding area, the improvement comprising said fine-grinding area comprising a flexible matrix consisting of a textile material which is more flexible than the material of a hard matrix and has an open structure, said textile material of said fine-grinding area being bonded with a secondary bonding agent which assists in providing and maintaining the open structure and the flexibility and strength of said fine-grinding area, the strength of the fine-grinding area relative to that of the rough-grinding area being so dimensioned that, with the workpiece abutting over the entire grinding area, at the outside portion of the fine-grinding area, that proportion of the entire grinding pressure is absorbed in the fine-grinding area that corresponds to the proportion of its contact surface with respect to the workpiece.

9. A grinding tool as claimed in claim 8, wherein the fine-grinding area consists of several sub-areas having stepped grain sizes.

10. A grinding tool as claimed in claim 8, wherein the matrix of the fine-grinding area consists of several layers of an abrasive-coated cloth which is connected to said secondary bonding agent.

11. A grinding tool as claimed in claim 8, wherein the matrix of the fine-grinding area consists of a tangled fibre mat which is bonded with said secondary bonding agent and contains the abrasive grains.

12. A grinding tool as claimed in claim 8, wherein the matrix of the fine-grinding area is designed as a textile wound package.

13. A grinding tool as claimed in claim 8, wherein said secondary bonding agent is a tough-elastic to elastomeric, more especially foamed, plastics material.

14. A grinding tool as claimed in claim 8, wherein additional abrasive grains are added to said secondary bonding agent.

* * * * *